US011821435B2

(12) United States Patent
Miny

(10) Patent No.: US 11,821,435 B2
(45) Date of Patent: Nov. 21, 2023

(54) COMPRESSOR ROTOR HAVING FLOW LOOP THROUGH TIE BOLT

(71) Applicant: Siemens Energy Global GmbH & Co. KG, Munich (DE)

(72) Inventor: Kevin Miny, Essen (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 18/000,935

(22) PCT Filed: Jul. 2, 2020

(86) PCT No.: PCT/EP2020/068662
§ 371 (c)(1),
(2) Date: Dec. 7, 2022

(87) PCT Pub. No.: WO2022/002406
PCT Pub. Date: Jan. 6, 2022

(65) Prior Publication Data
US 2023/0193920 A1 Jun. 22, 2023

(51) Int. Cl.
*F04D 29/26* (2006.01)
*F04D 29/10* (2006.01)
(Continued)

(52) U.S. Cl.
CPC ..... *F04D 29/266* (2013.01); *F04D 17/12* (2013.01); *F04D 29/054* (2013.01); *F04D 29/08* (2013.01); *F04D 29/102* (2013.01)

(58) Field of Classification Search
CPC ..... F04D 29/266; F04D 17/12; F04D 29/054; F04D 29/08; F04D 29/102
See application file for complete search history.

(56) References Cited

U.S. PATENT DOCUMENTS 2,458,149 A * 1/1949 Cronstedt ..... F01D 5/06 416/244 R
3,267,868 A * 8/1966 Oswald, V ..... F04D 29/588 415/58.4
(Continued)

FOREIGN PATENT DOCUMENTS

DE 102013005431 A1 10/2014
JP S61188356 A 8/1986
(Continued)

OTHER PUBLICATIONS

PCT International Search Report and Written Opinion of International Searching Authority dated Mar. 4, 2021 corresponding to PCT International Application No. PCT/EP2020/068662 filed Jul. 2, 2020.

*Primary Examiner* — Eldon T Brockman
*Assistant Examiner* — Andrew J Marien
(74) *Attorney, Agent, or Firm* — Enrique J. Mora

(57) ABSTRACT

Compressor rotor structure for turbomachinery, such as a compressor, is provided. Disclosed embodiments may involve a flow loop that at least in part flows through the interior of the tie bolt or by way of a venting arrangement that at least in part extends through one of the rotor shafts of the rotor structure. Disclosed embodiments may further benefit from seal elements that may be arranged to inhibit passage onto respective hirth couplings of the process fluid being processed by the compressor. In operation, the flow loop may be appropriately pressurized to keep any residual seal leakage that may develop in one or more of the seal elements from travelling onto the hirth couplings.

15 Claims, 5 Drawing Sheets

(51) Int. Cl.

| | |
|---|---|
| ***F04D 29/054*** | (2006.01) |
| ***F04D 17/12*** | (2006.01) |
| ***F04D 29/08*** | (2006.01) |

(56) References Cited

U.S. PATENT DOCUMENTS

| | | | | |
|---|---|---|---|---|
| 6,267,553 | B1 | 7/2001 | Burge | |
| 6,464,469 | B1 | 10/2002 | Grob et al. | |
| 2003/0017878 | A1* | 1/2003 | Muju | F16D 1/033 464/157 |
| 2011/0262284 | A1* | 10/2011 | Guernard | F04D 17/122 29/428 |
| 2015/0316064 | A1* | 11/2015 | Kosamana | F04D 29/054 415/203 |
| 2016/0319820 | A1* | 11/2016 | Venkatachalam | F01D 5/066 |
| 2021/0262346 | A1* | 8/2021 | Patel | F01D 11/003 |

FOREIGN PATENT DOCUMENTS

| | | | |
|---|---|---|---|
| JP | S6392098 | U | 6/1988 |
| JP | 2001041191 | A | 2/2001 |
| JP | 2003129997 | A | 5/2003 |
| JP | 2006138255 | A | 6/2006 |
| JP | 2014194217 | A | 10/2014 |
| JP | 2016540927 | A | 12/2016 |
| WO | 2014095742 | A1 | 6/2014 |

* cited by examiner

COMPRESSOR ROTOR HAVING FLOW LOOP THROUGH TIE BOLT

BACKGROUND

Disclosed embodiments relate generally to the field of turbomachinery, and, more particularly, to a rotor for a turbomachine, such as a compressor.

Turbomachinery is used extensively in the oil and gas industry, such as for performing compression of a process fluid, conversion of thermal energy into mechanical energy, fluid liquefaction, etc. One example of such turbomachinery is a compressor, such as a centrifugal compressor.

DETAILED DESCRIPTION

Figure 1:
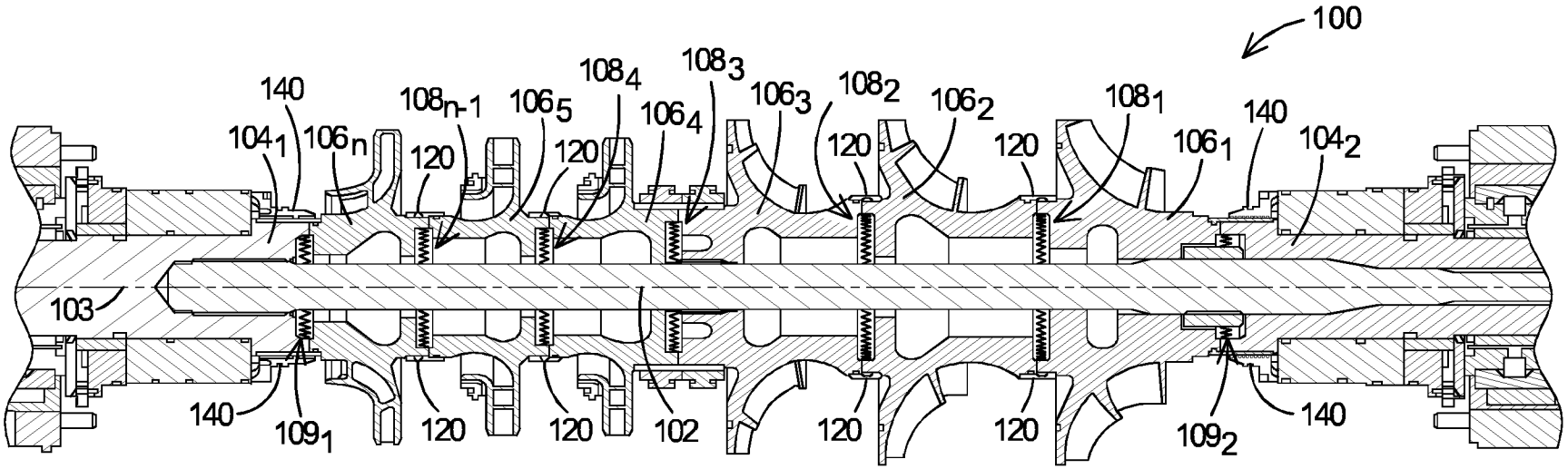
FIG. 1 illustrates a fragmentary cross-sectional view of one non-limiting embodiment of a disclosed rotor structure, as may be used in industrial applications involving turbomachinery, such as without limitation, centrifugal compressors.

As would be appreciated by those skilled in the art, turbomachinery, such as centrifugal compressors, may involve rotors of tie bolt construction (also referred to in the art as thru bolt or tie rod construction), where the tie bolt supports a plurality of impeller bodies and where adjacent impeller bodies may be interconnected to one another by way of elastically averaged coupling techniques, such as involving hirth couplings or curvic couplings. These coupling types use different forms of face gear teeth (straight and curved, respectively) to form a robust coupling between two components.

These couplings and associated structures may be subject to greatly varying forces (e.g., centrifugal forces), such as from an initial rotor speed of zero revolutions per minute (RPM) to a maximum rotor speed, (e.g., as may involve tens of thousands of RPM). Additionally, these couplings and associated structures may be exposed to contaminants and/or byproducts that may be present in process fluids processed by the compressor. If so exposed, such couplings and associated structures could be potentially affected in ways that could impact their long-term durability. By way of example, a combination of carbon dioxide (CO2), liquid water and high-pressure levels can lead to the formation of carbonic acid (H2CO3), which is a chemical compound that can corrode, rust or pit certain steel components. Physical debris may also be present in the process fluids that if allowed to reach the hirth couplings and associated structures could potentially affect their functionality and durability.

In view of the foregoing considerations, to attain consistent high performance and long-term durability in a centrifugal compressor, disclosed embodiments may involve seal elements arranged to cover respective hirth couplings to inhibit passage onto the respective hirth coupling of process fluid being processed by the compressor, and thus ameliorate the issues discussed above.

The present inventor has recognized that—notwithstanding of utilization of seal elements—some residual leakage of process fluid may still occur into one or more cavities that may be disposed about the tie bolt. Leakage of process fluid into such cavities, for example, could detrimentally affect aerodynamic and/or rotordynamics performance of the rotor structure. For example, condensate or moisture that could be trapped in such cavities could potentially lead to increased levels of rotor vibration. For example, high pressure gas could leak from an area of high potential pressure to an area of low potential pressure and possibly lead to increased gas recycle and reduced aerodynamic performance. Accordingly, disclosed embodiments may involve a flow loop that provides fluid communication through the tie bolt and is appropriately pressurized to keep any such residual leakage from travelling onto the hirth couplings. Certain disclosed embodiments may optionally involve a venting arrangement for venting such cavities, such as by way of a venting outlet.

In the following detailed description, various specific details are set forth in order to provide a thorough understanding of such embodiments. However, those skilled in the art will understand that disclosed embodiments may be practiced without these specific details that the aspects of the present invention are not limited to the disclosed embodiments, and that aspects of the present invention may be practiced in a variety of alternative embodiments. In other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated. Moreover, repeated usage of the phrase "in one embodiment" does not necessarily refer to the same embodiment, although it may.

It is noted that disclosed embodiments need not be construed as mutually exclusive embodiments, since aspects of such disclosed embodiments may be appropriately combined by one skilled in the art depending on the needs of a given application.

FIG. 1 illustrates a fragmentary cross-sectional view of one non-limiting embodiment of a disclosed rotor structure 100, as may be used in industrial applications involving turbomachinery, such as without limitation, compressors (e.g., centrifugal compressors, etc.).

In one disclosed embodiment, a tie bolt 102 extends along a rotor axis 103 between a first end and a second end of the tie bolt 102. A first rotor shaft $\mathbf{104}_1$ may be fixed to the first end of tie bolt 102. A second rotor shaft $\mathbf{104}_2$ may be fixed to the second end of tie bolt 102. Rotor shafts $\mathbf{104}_1$, $\mathbf{104}_2$ may be referred to in the art as stubs shafts. It will be appreciated that in certain embodiments more than two rotor shafts may be involved.

A plurality of impeller bodies 106, such as impeller bodies $\mathbf{106}_1$ through $\mathbf{106}_n$, may be disposed between rotor shafts $\mathbf{104}_1$, $\mathbf{104}_2$. In the illustrated embodiment, the number of impeller bodies is six and thus n=6; it will be appreciated that this is just one example and should not be construed in a limiting sense regarding the number of impeller bodies that may be used in disclosed embodiments.

By way of example, a first impeller body $\mathbf{106}_1$ of the plurality of impeller bodies is arranged to provide a first stage of compression to a process fluid, and each subsequent impeller body provides a subsequent stage of compression to the process fluid. The embodiments respectively illustrated in FIGS. 1 and 3 involve a center-hung configuration of back-to-back impeller compression stages; it will be appreciated that this configuration is just one example compressor configuration and should not be construed in a limiting sense regarding the applicability of disclosed embodiments.

In a back-to-back configuration, a given compressor may, for example, comprise a first compressor section including a portion of the plurality of impeller bodies. Each respective impeller body in the first compressor section having a respective inlet arranged to receive a flow of the process fluid in a first direction. The respective inlet of a respective impeller body is disposed opposite to a back of the respective impeller body. The compressor further comprises a second compressor section including the remainder of the plurality of impeller bodies. Each respective impeller body in the second compressor section having a respective inlet arranged to receive the flow of the process fluid in a second direction opposite the first direction. That is, the compression stages of the first compressor section are oriented opposite to the compression stages of the second compressor section. One advantage of the back-to-back configuration is its innate characteristic to reduce and substantially balance the axial thrust forces generated in the impellers of each compressor section. Since the two compressor sections are oriented in an opposite direction, the generated axial thrust forces in each section are acting in opposite directions. This may be particularly beneficial in high pressure, high density compression applications such as gas injection services where unbalanced thrust forces can be substantial.

Returning to FIG. 1, the plurality of impeller bodies 106 is supported by tie bolt 102 and is mechanically coupled to one another along rotor axis 103 by way of a plurality of hirth couplings, such as hirth couplings 1081 through $\mathbf{108}_{n-1}$. In the illustrated embodiment, since as noted above, the number of impeller bodies is six, then the number of hirth couplings between adjoining impeller bodies 106 would be five. It will be appreciated that two additional hirth couplings $\mathbf{109}_1$ and $\mathbf{109}_2$ may be used to respectively mechanically couple the impeller bodies $\mathbf{106}_n$, $\mathbf{106}_1$ with respectively abutting rotor shafts $\mathbf{104}_1$, $\mathbf{104}_2$. It will be appreciated that the foregoing arrangement of impeller bodies and hirth couplings is just one example and should not be construed in a limiting sense.

A plurality of respective seal elements 120 may be arranged to respectively span (e.g., along 360 degrees) a circumferentially extending junction between adjoining impeller bodies to inhibit passage onto respective hirth couplings 108 of process fluid being processed by the compressor. Further seal elements 140 may be used to provide a sealing functionality between a respective abutting impeller body (e.g, impeller body $\mathbf{106}_1$; impeller body $\mathbf{106}_n$) and a respective rotor shaft (e.g., rotor shaft $\mathbf{104}_2$; rotor shaft $\mathbf{104}_1$) of the two rotor shafts $\mathbf{104}_1$, $\mathbf{104}_2$. The respective impeller body $\mathbf{106}_1$ is mechanically coupled by hirth coupling $\mathbf{109}_2$ to the respective rotor shaft $\mathbf{104}_2$ and respective impeller body $\mathbf{106}_n$ is mechanically coupled by hirth coupling $\mathbf{109}_1$ to respective rotor shaft $\mathbf{104}_1$.

Figure 2:
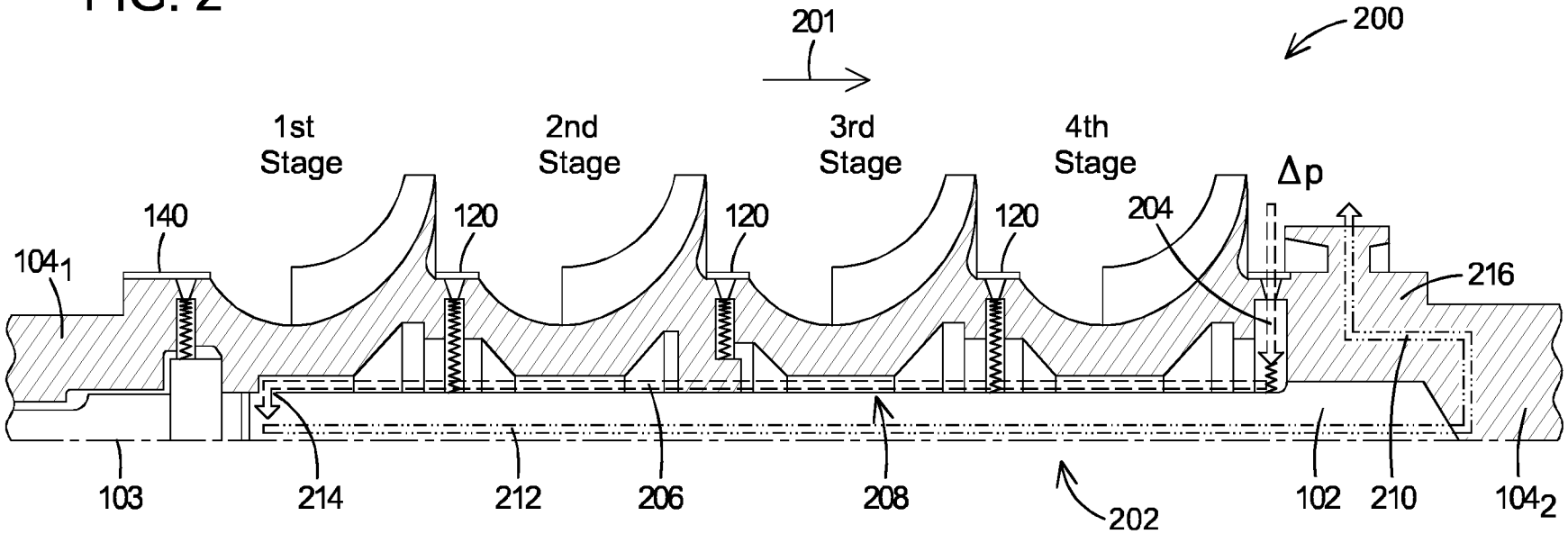
FIG. 2 illustrates a fragmentary cross-sectional view of one non-limiting embodiment of a disclosed rotor structure involving a flow loop in a compressor with compression stages arranged in a straight-through configuration.

FIG. 2 illustrates a fragmentary cross-sectional view of one non-limiting embodiment of a disclosed rotor structure 200, where the compression stages are arranged in a straight-through configuration aligned along a common direction, such as indicated by arrow 201. As schematically shown in FIG. 2, disclosed rotor structure 200 includes a respective flow loop 202 that, without limitation, may be defined by an input flow section 204 (schematically represented by dashed lines) extending at least in part along a flow channel 206 formed between respective impeller bodies of the plurality of impeller bodies and a radially outward surface 208 of tie bolt 102.

Flow loop 202 is further defined by a return flow section 210 (schematically represented by dashed and dotted lines), where at least a portion of return flow section 210 is defined by a flow channel 212 extending within tie bolt 102. For example, flow channel 212 may extend through an inner space defined by a bore 109 (FIG. 5) that extends along rotor axis 103 within the center line of tie bolt 102. Tie bolt 102 can further define a thru hole 214 (also seen in FIG. 5) through the solid core of tie bolt 102 to establish fluid communication between input flow section 204 and return flow section 210. In one non-limiting embodiment, thru hole 214 may be located between an upstream point and a downstream point of the first stage of compression (labelled $1^{st}$ stage in FIG. 2).

In one non-limiting embodiment, input flow section 204 of flow loop 202 is fluidly coupled with a first location exposed to the process fluid and return flow section 210 is fluidly coupled with a second location outside any of the stages of compression. A pressure differential ($\Delta p$) between the first location and the second location establishes a flow of fluid in the flow loop.

In the disclosed rotor structure 200 shown in FIG. 2, the first location may be disposed at the outlet of the last stage of compression (labelled $4^{th}$ stage in FIG. 2) and the second location may be disposed in a balance piston 216 disposed downstream from the last stage of compression. As would be readily appreciated by one skilled in the art, a balance piston seal—in connection with balance piston 216—is commonly used to seal the high-pressure area (e.g., first location) with respect to the relatively lower-pressure area (e.g., second location) to prevent or at least reduce leakage about the tie bolt from the high-pressure area to the relatively lower-pressure area. The balance piston seal may be a labyrinth seal axially extending between a rotating portion and a stationary portion of balance piston 216.

It will be appreciated that the pressure differential formed between such first location and second location is effective to have low impact on the efficiency of the compressor since the pressure differential between such locations is relatively lower compared to implementations where the pressure differential may, for example, be arranged between the first stage of compression and the last stage of compression, where a relatively larger pressure differential would be formed and in turn this would lead to a relatively larger mass flow in the flow channel/s and thus to decreased compressor efficiency.

It is noted that input flow section 204 is at a location that experiences the highest pressure level compared to the respective pressure levels experienced by hirth coupling locations disposed upstream from input flow section 204, and thus the pressure level in flow loop 202 would be relatively higher compared to the respective pressure levels experienced by such upstream hirth coupling locations.

Consequently, in the event of any residual leakage through any of seal elements 120, the pressurized flow loop 202 would be effective to keep such residual leakage from entering into a respective hirth coupling, such as otherwise would enter through the outer diameter (OD) and travel onto the inner diameter (ID) of the hirth coupling. Moreover, process fluid received at input flow section 204, being substantially pressurized and warm, does not contain any liquid condensate, as would likely be the case in the first stage, for example; thus avoiding trapping of condensate or moisture in internal cavities, such as internal cavities about the tie bolt.

It is further noted that the balance piston seal axially extending in piston seal 216 would experience a certain delta p drop along its axial length. Accordingly, the outlet of return flow section 210, based on the needs of a given application, can be selectively positioned at an axial location on balance piston 216, such that just sufficient pressure differential (Δp) is generated between the first location and the second location to fluidly actuate the flow loop but not so much (Δp) is generated that would result in excessive mass flow through the flow loop and in turn lead to potentially excessive internal recycle losses and lower efficiency in the given application.

Figure 3:
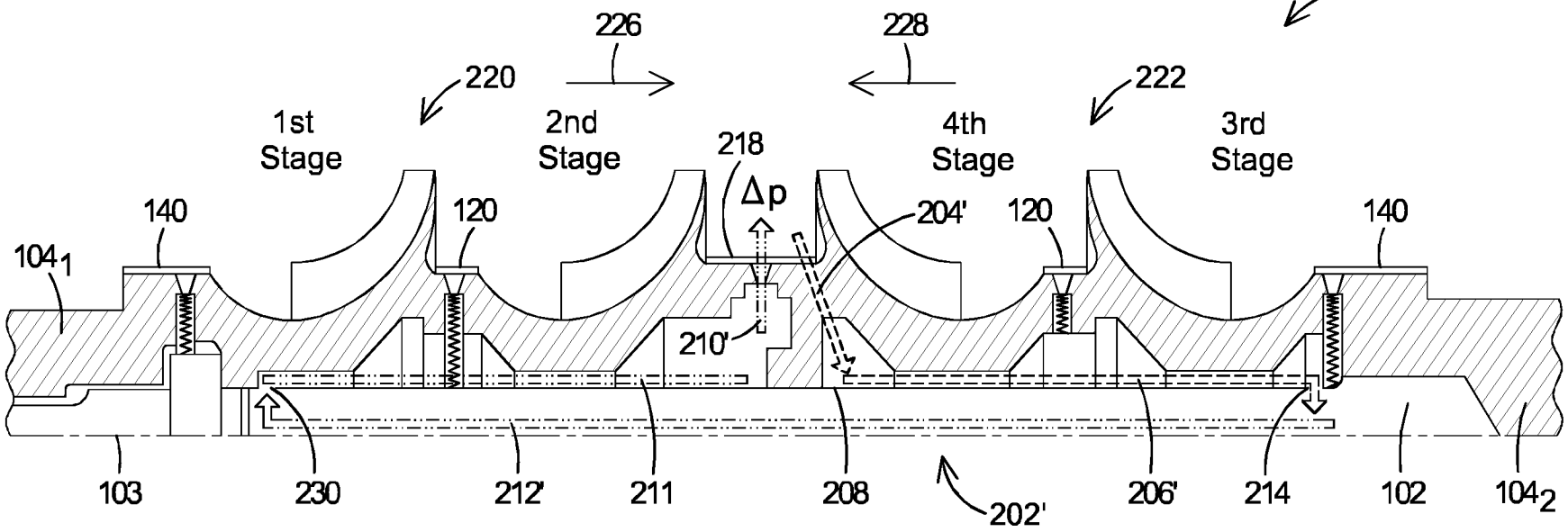
FIG. 3 illustrates a fragmentary cross-sectional view of one non-limiting embodiment of a disclosed rotor structure involving a flow loop in a compressor with compression stages arranged in a back-to-back configuration.

FIG. 3 illustrates a fragmentary cross-sectional view of one non-limiting embodiment of a disclosed rotor structure 200', where the plurality of impeller bodies is arranged along rotor axis 103 in a back-to-back configuration of a first compressor section 220 comprising, for example, two compression stages (labeled $1^{st}$ stage and $2^{nd}$ stage) and a second compressor section 222 comprising, for example, two additional compression stages (labeled $3^{rd}$ stage and $4^{th}$ stage) that in combination form the compressor. In this example, the impellers of first compressor section 220 are oriented opposite to the compression stages of second compressor section 222, as schematically represented by arrows 226 and 228.

As schematically shown in FIG. 3, disclosed rotor structure 200' includes a respective flow loop 202', conceptually analogous to flow loop 202 as described above in the context of FIG. 2. Flow loop 202' is defined by an input flow section 204' (schematically represented by dashed lines) extending at least in part along a flow channel 206' formed between respective impeller bodies of second compressor section 222 and radially outward surface 208 of tie bolt 102.

Flow loop 202' is further defined by a return flow section 210' (schematically represented by dashed and dotted lines), where at least a portion of return flow section 210' is defined by a flow channel 212' extending within tie bolt 102. That is, flow channel 212' extends through the inner space of tie bolt 102. In this embodiment, another portion of return flow section 210' is defined by a further flow channel 211 defined between respective impeller bodies of first compressor section 220 and radially outward surface 208 of tie bolt 102.

Without limitation, input flow section 204' of flow loop 202' is fluidly coupled with a first location exposed to the process fluid and return flow section 210' is fluidly coupled with a second location outside any of the stages of compression. A pressure differential (AP) between the first location and the second location establishes a flow of fluid in the flow loop.

In this embodiment, the first location may be disposed at the outlet of the last stage of compression (labeled $4^{th}$ stage) of second compressor section 222 and the second location may be disposed in a centrally located balance piston 218 (also known in the art as a division wall spacer) disposed between first compressor section 220 and second compressor section 222. As would be appreciated by one skilled in the art, a division wall seal—in connection with division wall spacer 218—is commonly used to seal the high-pressure area (e.g., first location) with respect to the relatively lower-pressure area (e.g., second location) to prevent or at least reduce leakage from the $4^{th}$ stage to the $2^{nd}$ stage and also leakage about the tie bolt from the high-pressure area 204' to the relatively lower-pressure area 210'.

It will be appreciated that the division wall spacer in a back-to-back compressor configuration functions conceptually analogous to the balance piston in a straight-through compressor configuration. The division wall is a non-rotating component that in part holds the division wall seal that provides sealing functionality with respect to a corresponding rotating component, which is the division wall spacer. Once again, it will be appreciated that the pressure differential formed between such first location and second location is effective to have low impact on the efficiency of the compressor since the pressure differential between such locations is relatively low compared to flow implementations where the pressure differential may, for example, be arranged between the first and the last stage of compressions, where a relatively larger pressure differential would be formed and in turn this would lead to a relatively larger mass flow in the flow channel/s and thus to decreased compressor efficiency.

This embodiment also provides at least the following advantages. As discussed above in the context of FIG. 2, for example, input flow section 204' is at a location that experiences the highest pressure level compared to the respective pressure levels experienced by the remaining hirth coupling locations, and thus the pressure level in flow loop 202' would be relatively higher compared to the respective pressure levels experienced by such remaining hirth coupling locations. Consequently, in the event of any residual leakage through any of seal elements 120, the pressurized flow loop 202' would be effective to keep such residual leakage from entering into a respective hirth coupling, such as otherwise would enter through the OD and travel onto the ID of the hirth coupling. Once again, process fluid received at input flow section 204', being substantially pressurized and warm, does not contain any liquid condensate. Thus, avoiding trapping of condensate or moisture in internal cavities, such as internal cavities about the tie bolt.

In this embodiment a location of thru hole 214 to establish fluid communication between input flow section 204' and return flow section 210' may be between an upstream point and a downstream point of the first stage of compression (labeled $3^{rd}$ stage) of second compressor section 222.

Tie bolt 102 may define a second thru hole 230 disposed at a further location of tie bolt 102 arranged to establish fluid communication between flow channel 212' extending within the tie bolt and further flow channel 211. The location of second thru hole 230 may be between an upstream point and a downstream point of the first stage of compression (labeled $1^{st}$ stage) of first compressor section 220.

Figure 4:
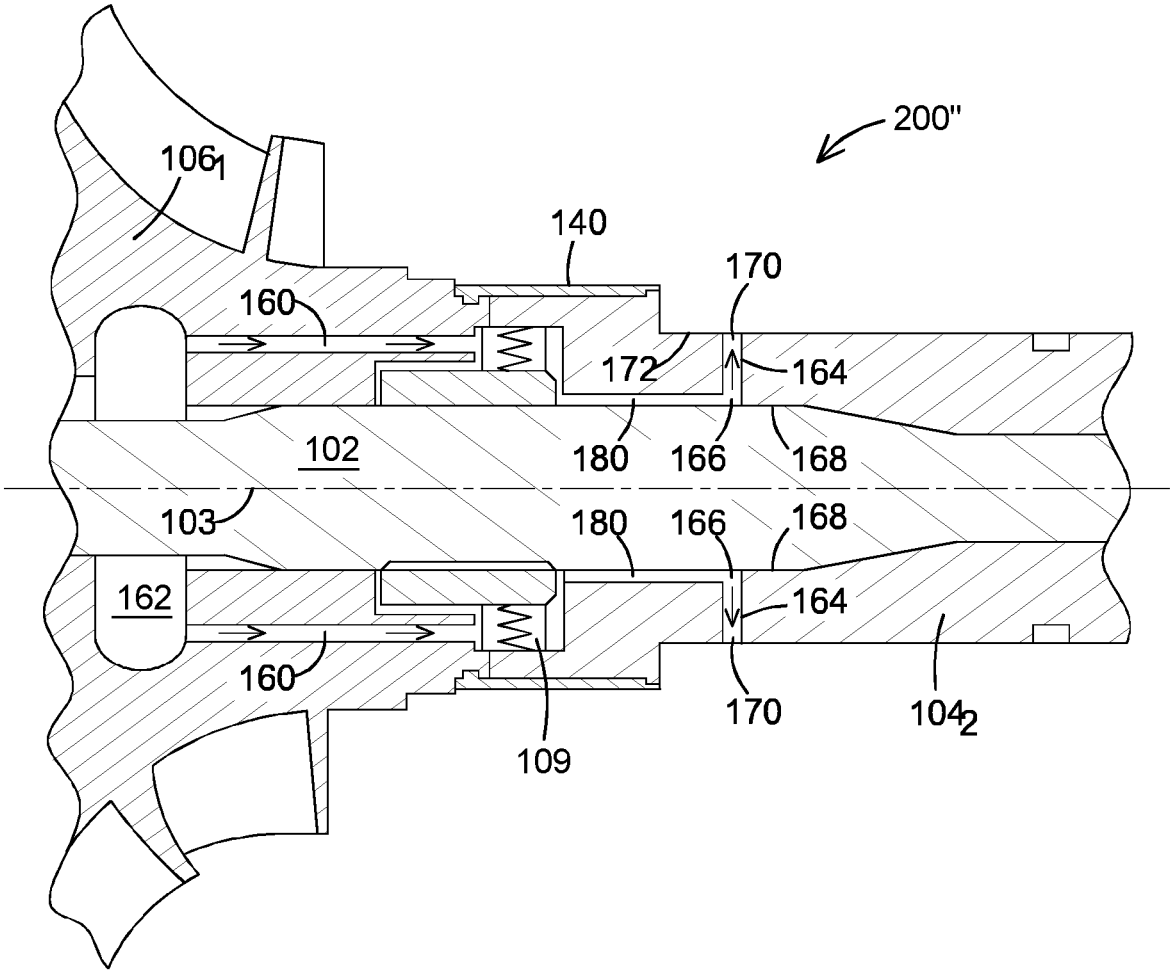
FIG. 4 illustrates a zoomed-in, fragmentary cross-sectional view of certain non-limiting structural and/or operational relationships involving a venting arrangement that may be featured in certain disclosed embodiments for venting one or more cavities disposed about the tie bolt.

FIG. 4 illustrates a zoomed-in, fragmentary cross-sectional view of one non-limiting embodiment of a disclosed rotor structure 200", where a respective impeller body (e.g., impeller body $\mathbf{106}_1$) of the plurality of impeller bodies is in abutting relationship with rotor shaft $\mathbf{104}_2$. In this embodiment, impeller body $\mathbf{106}_1$ may include at least one axially-extending conduit 160 in fluid communication with one or more cavities 162 disposed about the tie bolt 102 along rotor axis 103.

In one non-limiting embodiment, at least one radially-extending conduit 164 may be constructed through rotor shaft $104_2$. Radially-extending conduit 164 may define an opening 166 at a radially-inward surface 168 of rotor shaft $104_2$ permitting fluid communication through a gap 180 about tie bolt 102 with axially-extending conduit 160. Radially-extending conduit 164 may define another opening 170 at a radially-outward surface 172 of rotor shaft $104_2$ that, for example, may be used to vent process fluid that may have leaked into the one or more cavities 162 disposed about the tie bolt along the rotor axis. The foregoing arrangement disclosed in the context of impeller body $106_1$ and abutting rotor shaft $104_2$ could alternatively be implemented in connection with impeller body $106_n$ and abutting rotor shaft $104_1$ (FIG. 1).

Figure 5:
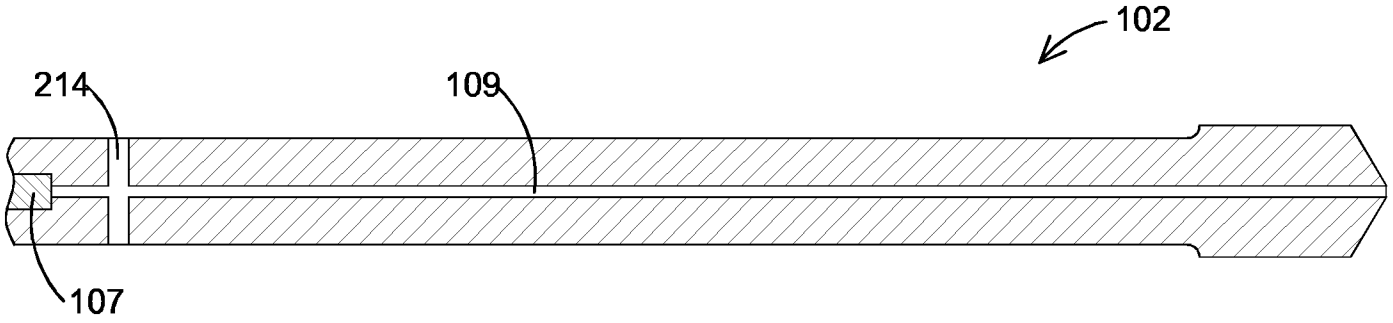
FIG. 5 illustrates a fragmentary view of one non-limiting embodiment of a tie bolt including a bore and a thru hole arranged to provide fluid communication in the disclosed flow loop.

FIG. 5 illustrates a fragmentary view of one non-limiting embodiment of tie bolt 102 including bore 109 (conceptually analogous to a gun bore hole) and thru hole 214, which are arranged to provide fluid communication through the solid core of tie bolt 102. A plug 107 may be used to plug bore 109 downstream of thru hole 214.

In operation, disclosed embodiments can make use of seal elements appropriately arranged to cover the hirth couplings and effective to inhibit passage onto the respective hirth coupling of process fluid being processed by the compressor, and thus inhibiting potential exposure of the hirth couplings and associated structures to contaminants, chemical byproducts, and/or physical debris.

In operation, disclosed embodiments can make use of a flow loop that at least in part flows through the interior of the tie bolt, as described in the context of FIGS. 2 and 3. In operation the flow loop may be appropriately pressurized to keep any such residual seal leakage from travelling onto the hirth couplings.

In operation, certain disclosed embodiments can optionally use a venting arrangement that at least in part extends through one of the rotor shafts of the rotor structure, as described in the context of FIG. 4.

While embodiments of the present disclosure have been disclosed in exemplary forms, it will be apparent to those skilled in the art that many modifications, additions, and deletions can be made therein without departing from the scope of the invention and its equivalents, as set forth in the following claims.

What is claimed is:

1. A rotor structure in a compressor, the rotor structure comprising:

a tie bolt having a bore that extends along a rotor axis and defines an inner space in fluid communication with a thru hole in the tie bolt;

a plurality of impeller bodies supported by the tie bolt;

wherein a first impeller body of the plurality of impeller bodies is arranged to provide a first stage of compression to a process fluid, and each subsequent impeller body provides a subsequent stage of compression to the process fluid; and a flow loop being defined by an input flow section extending at least in part along a flow channel between respective impeller bodies of the plurality of impeller bodies and a radially outward surface of the tie bolt, the flow loop being further defined by a return flow section, wherein at least a portion of the return flow section is defined by a flow channel extending within the inner space of the tie bolt, wherein the thru hole establishes fluid communication between the input flow section and the return flow section.

2. The rotor structure of claim 1, wherein the input flow section of the flow loop is fluidly coupled with a first location exposed to the process fluid, and the return flow section is fluidly coupled with a second location outside any of the stages of compression.

3. The rotor structure of claim 2, wherein a pressure differential between the first location and the second location establishes a flow of fluid in the flow loop.

4. The rotor structure of claim 2, wherein the plurality of impeller bodies is arranged along the rotor axis in a straight-through configuration, wherein the thru hole in the tie bolt is located between an upstream point and a downstream point of the first stage of compression.

5. The rotor structure of claim 4, further comprising a balance piston disposed downstream from a last stage of compression, wherein the first location is disposed at an outlet of the last stage of compression and the second location is fluidly coupled to the return flow section though the balance piston.

6. The rotor structure of claim 2, wherein the plurality of impeller bodies includes a first compressor section including a portion of the plurality of impeller bodies arranged to receive a flow of the process fluid in a first direction, and a second compressor section including the remainder of the plurality of impeller bodies arranged to receive the flow of the process fluid in a second direction opposite the first direction, wherein the first location is disposed at an outlet of a last stage of compression of the second compressor section and wherein the second location is disposed in a division wall spacer of the first compressor section and the second compressor section.

7. The rotor structure of claim 6, wherein the thru hole is located between an upstream point and a downstream point of the first stage of compression of the second compressor section.

8. The rotor structure of claim 6, wherein another portion of the return flow section is defined by a further flow channel defined between respective impeller bodies of the first compressor section and the radially outward surface of the tie bolt.

9. The rotor structure of claim 8, wherein the tie bolt further defines a second thru hole disposed at a further location of the tie bolt arranged to establish fluid communication between the flow channel extending within the inner space of the tie bolt and the further flow channel.

10. The rotor structure of claim 9, wherein the second thru hole is located between an upstream point and a downstream point of the first stage of compression of the first compressor section.

11. The rotor structure of claim 1, wherein a respective impeller body of the plurality of impeller bodies comprises two mutually opposed surfaces respectively abutting with respective corresponding surfaces of two adjacent impeller bodies.

12. The rotor structure of claim 1, further comprising two rotor shafts affixed to the tie bolt, wherein a respective impeller body of the plurality of impeller bodies comprises two mutually opposed surfaces respectively abutting with an adjacent impeller body and a corresponding surface of a rotor shaft of the two rotor shafts.

13. The rotor structure of claim 1, wherein any two adjacent impeller bodies, or an impeller body and an adjacent rotor shaft are mechanically connected to one another by respective hirth couplings for rotation about the rotor axis.

14. The rotor structure of claim 1, further comprising respective seal elements disposed onto respective outward surfaces of at least some of any two adjacent impeller bodies of the plurality of impeller bodies or onto respective outward surfaces of a respective impeller body and an adjacent rotor shaft.

15. A rotor structure in a compressor, the rotor structure comprising:

a tie bolt and two rotor shafts affixed to respective ends of the tie bolt;

a plurality of impeller bodies disposed between the two rotor shafts, the plurality of impeller bodies supported by the tie bolt;

a plurality of hirth couplings arranged to mechanically couple the plurality of impeller bodies to one another along a rotor axis;

a respective seal element affixed onto respective radially outward surfaces of any two adjoining impeller bodies of the plurality of impeller bodies to inhibit passage onto the respective hirth coupling of process fluid being processed by the compressor;

wherein a respective impeller body of the plurality of impeller bodies is in abutting relationship with a respective one of the two rotor shafts, wherein the respective impeller body defines at least one conduit in fluid communication with one or more cavities about the tie bolt along the rotor axis; and at least one conduit through the respective one of the two rotor shafts, the at least one conduit through the respective one of the two rotor shafts having a first opening at a radially-inward surface of the respective one of the two rotor shafts to provide fluid communication with the at least one conduit defined by the respective impeller body in fluid communication with the one or more cavities about the tie bolt along the rotor axis, the at least one conduit through the respective one of the two rotor shafts having a second opening at a radially-outward surface of the respective one of the two rotor shafts to provide an outlet to a fluid flow formed in response to leakage of some of the process fluid through the respective seal element into the one or more cavities about the tie bolt.

* * * * *